US010914090B2

(12) United States Patent
Badita et al.

(10) Patent No.: US 10,914,090 B2
(45) Date of Patent: Feb. 9, 2021

(54) QUADRIC SURFACE GRATE COVER

(71) Applicant: HYDROPOOL INC., Mississauga (CA)

(72) Inventors: Nicolae Badita, Brampton (CA); William J. Wright, Orangeville (CA)

(73) Assignee: Hydropool Inc.

( * ) Notice: Subject to any disclaimer, the term of this patent is extended or adjusted under 35 U.S.C. 154(b) by 0 days.

(21) Appl. No.: 16/776,722

(22) Filed: Jan. 30, 2020

(65) Prior Publication Data

US 2020/0362580 A1 Nov. 19, 2020

Related U.S. Application Data

(60) Provisional application No. 62/846,821, filed on May 13, 2019.

(51) Int. Cl.
*E04H 4/12* (2006.01)

(52) U.S. Cl.
CPC ..... *E04H 4/1218* (2013.01)

(58) Field of Classification Search
CPC ..... E04H 4/1218
USPC ..... 210/163, 164, 167.1, 167.19
See application file for complete search history.

(56) References Cited

U.S. PATENT DOCUMENTS 5,935,450 A * 8/1999 Benedict ..... E04H 4/1272 210/167.19
6,214,217 B1 * 4/2001 Sliger, Jr. ..... B01D 29/01 210/167.19
2010/0187169 A1 * 7/2010 Hilton ..... E04H 4/1236 210/163
2013/0020242 A1 * 1/2013 Vreeland ..... E03F 5/0404 210/163

FOREIGN PATENT DOCUMENTS

WO WO 2008/083424 A1 * 7/2008

* cited by examiner

*Primary Examiner* — Fred Prince
(74) *Attorney, Agent, or Firm* — Lorelei G. Graham

(57) ABSTRACT

A quadratic surface grate cover for a swimming pool including a hyperbolic paraboloid shaped frame having front side, a back side, a top side that runs parallel to a bottom side and two non-parallel ends that connect the top and bottom sides. The quadratic surface grate includes at least four trapezoid-shaped vented portions positioned within and across the frame so that the frame and the trapezoid-shaped portions flex in a concave direction between the two non-parallel ends and a convex direction between the two parallel sides.

8 Claims, 18 Drawing Sheets

QUADRIC SURFACE GRATE COVER

FIELD OF THE INVENTION

The present invention relates generally to the field of drains for swimming pools, spas and whirlpool baths and more particularly to an improved suctions fittings cover grate shape and design that provides for improved safety, avoiding entrapment without restricting the flow of water.

BACKGROUND OF THE INVENTION

Swimming pools, spas and whirlpool baths have utilized a variety of methods to ensure proper water flow through the pool while at the same time providing sufficient safety around the intake and outtake covers or grates. As water flow speed increases the suction created around the grate or cover is significant and the risk of a user's limbs being entrapped or caught increases. A variety of constructions have been adopted to overcome this problem while still ensuring safety of the user.

Swimming pools and swim spas typically have a drainage/suction fitting sump that is located in the back side of the swim spa where the water typically flows towards. The main water flow circulation happens with the circulation from the discharge of the pumps through the swim jet system along the swimming pool thereby creating flow or current through the swimming pool or spa. The water is then collected by the water collector system, then moves through the suction fitting system and is pumped through the suction plumbing system back to the swim spa pump system and the cycle repeats itself, thereby closing the loop on the water circulation system.

Other water flow systems or constructions have taken a different approach to this problem by having a sensor installed in the water suction line that would sense any increase in the force of the suction. After a short time delay at the elevated force in suction, the system would cut off the suction. However, this approach has the disadvantage that by the time the increase in suction is being sensed and the system shutting down, the person could be already pulled down by the force of the suction and still could obtain a serious injury.

The above mentioned pools will often have an unblockable grate cover installed over the opening of the sump to prevent any entrapment into the sump and to prevent any human limbs or larger areas of the human body to make contact with the considerable suction force in the bottom of the sump so as to avoid any injuries.

The considerable suction in the bottom of the sump does not create a forceful suction on the top of the grate that covers the sump because of the special design and size of the grate.

Thus a grate cover for a swimming pool which allows for increased water flow within the pool while ensuring no entrapment of a person and improved safety is desirable.

SUMMARY OF THE INVENTION

An object of one aspect of the present invention is to provide an improved quadratic surface grate for a swimming pool.

In accordance with one aspect of the present invention there is provided a quadratic surface grate cover for a swimming pool including a hyperbolic paraboloid shaped frame having front side, a back side, a top side that runs parallel to a bottom side and two non-parallel ends that connect the top and bottom sides. The quadratic surface grate includes at least four trapezoid-shaped vented portions positioned within and across the frame so that the frame and the trapezoid-shaped portions flex in a concave direction between the two non-parallel ends and a convex direction between the two parallel sides.

Conveniently the quadratic surface grate cover may be in combination with a sump having suction fittings for a swimming pool. The curvature of the frame ensures that there is never a part of the human body that could be suctioned on to the grate.

Preferably, the vents in each trapezoid-shaped portion are at least a thousand per square inch. Advantages of the present invention include and are not limited to improved strength, un-blockable cover and increased anti entrapment protection.

BRIEF DESCRIPTION OF THE DRAWINGS

A detailed description of the preferred embodiment is provided herein below by way of example only and with reference to the following drawings, in which.

Figure 1:
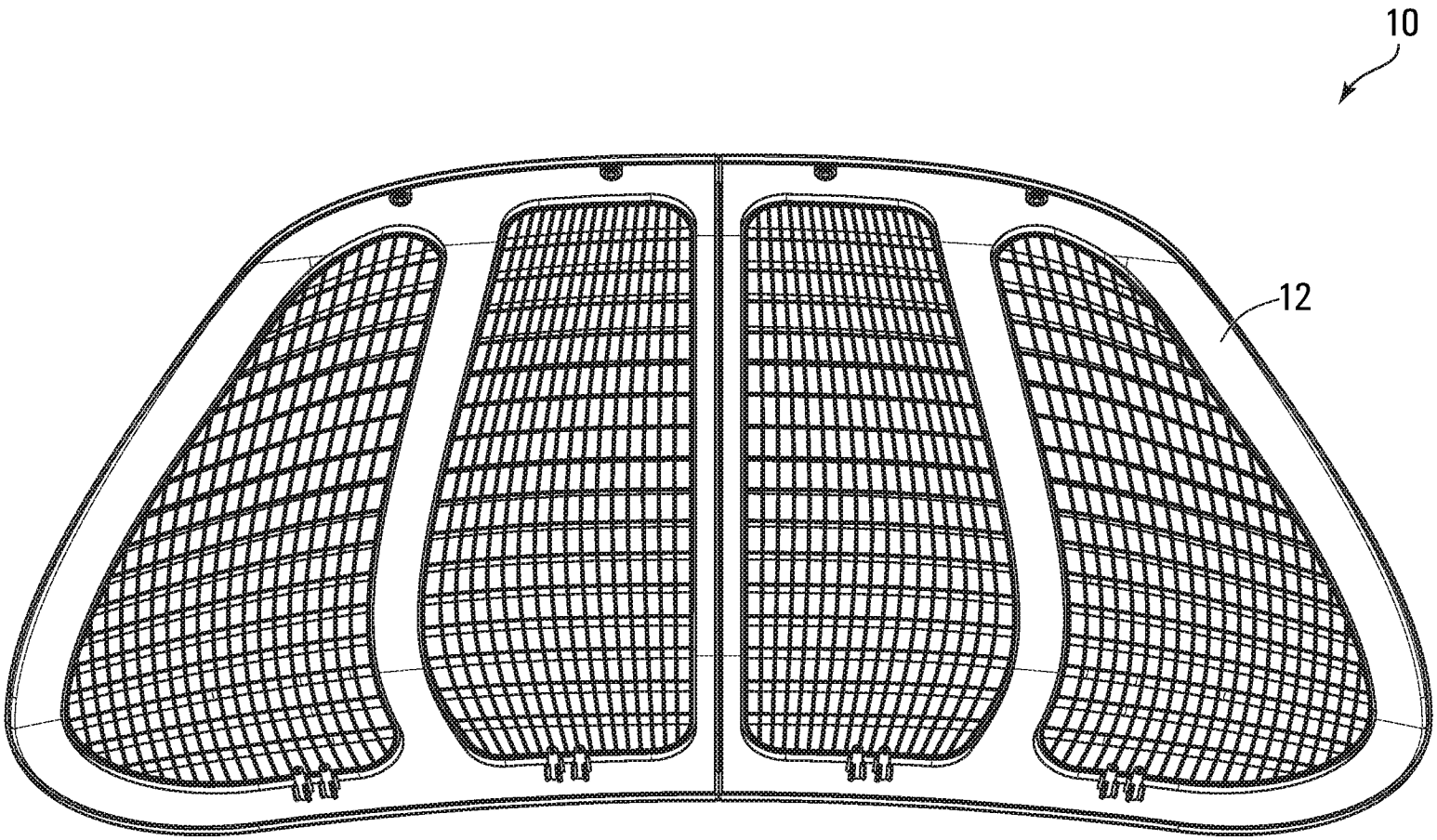
FIG. 1 in a back elevation view, illustrates a quadratic surface grate cover for a swimming pool in accordance with a preferred embodiment of the present invention.
Figure 2:
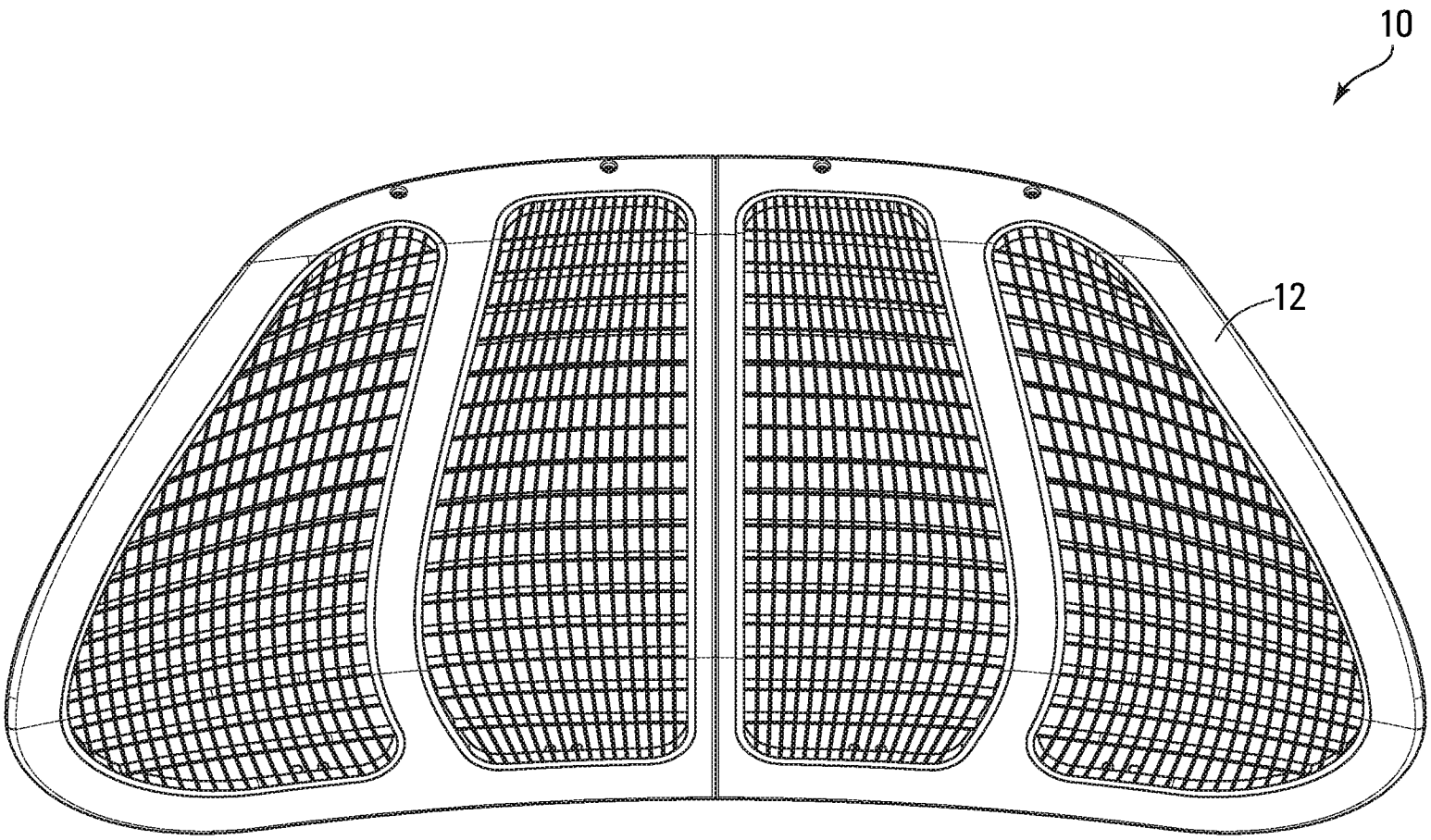
FIG. 2 in a front elevation view, illustrates the quadratic surface grate cover of FIG. 1.
Figure 3:
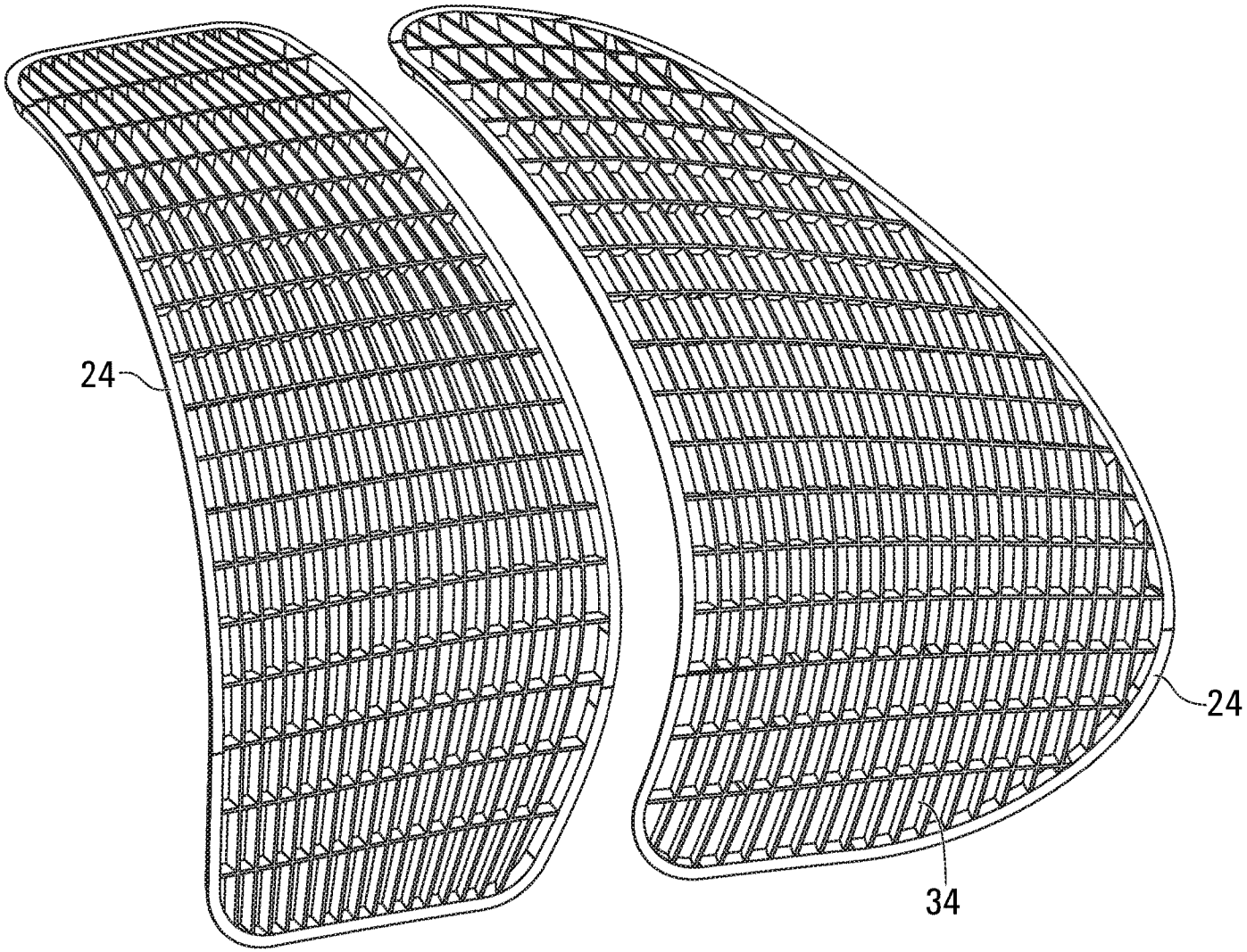
FIG. 3 in a front perspective view, illustrates the trapezoid-shaped vented portions of the quadratic surface grate cover of FIG. 1.
Figure 4:
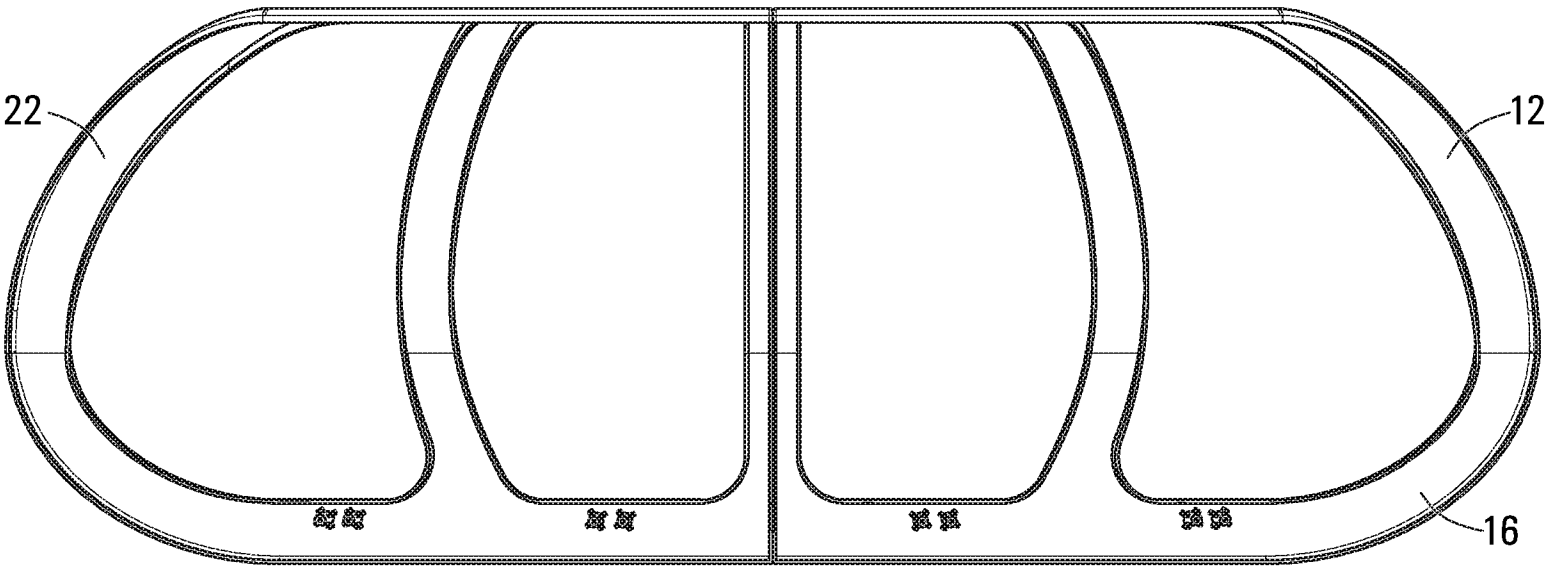
FIG. 4 in a hack elevation view, illustrates the frame of the quadratic surface grate cover of FIG. 1.
Figure 5:
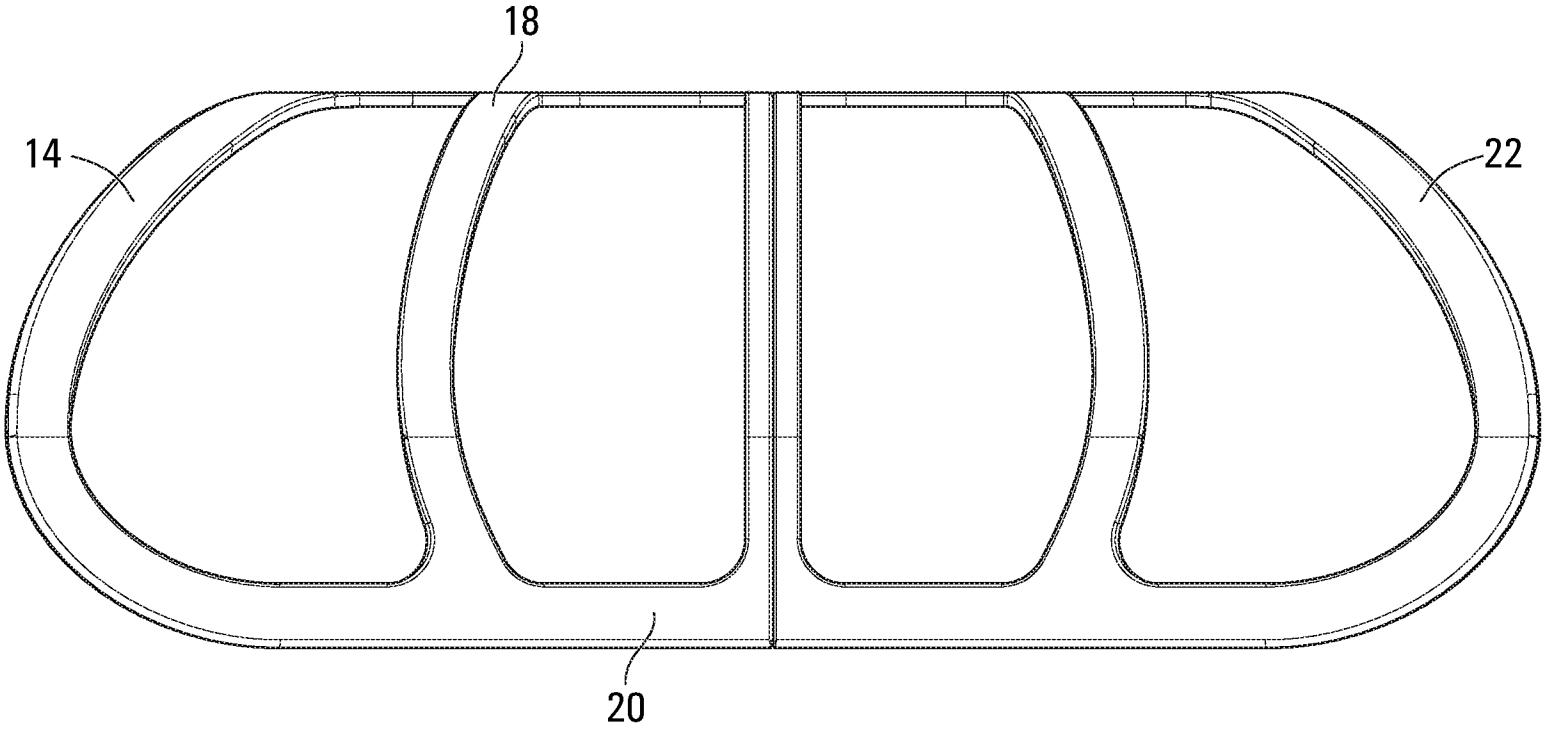
FIG. 5 in a from elevation view, illustrates the frame of the quadratic surface grate cover of FIG. 1.
Figure 6:
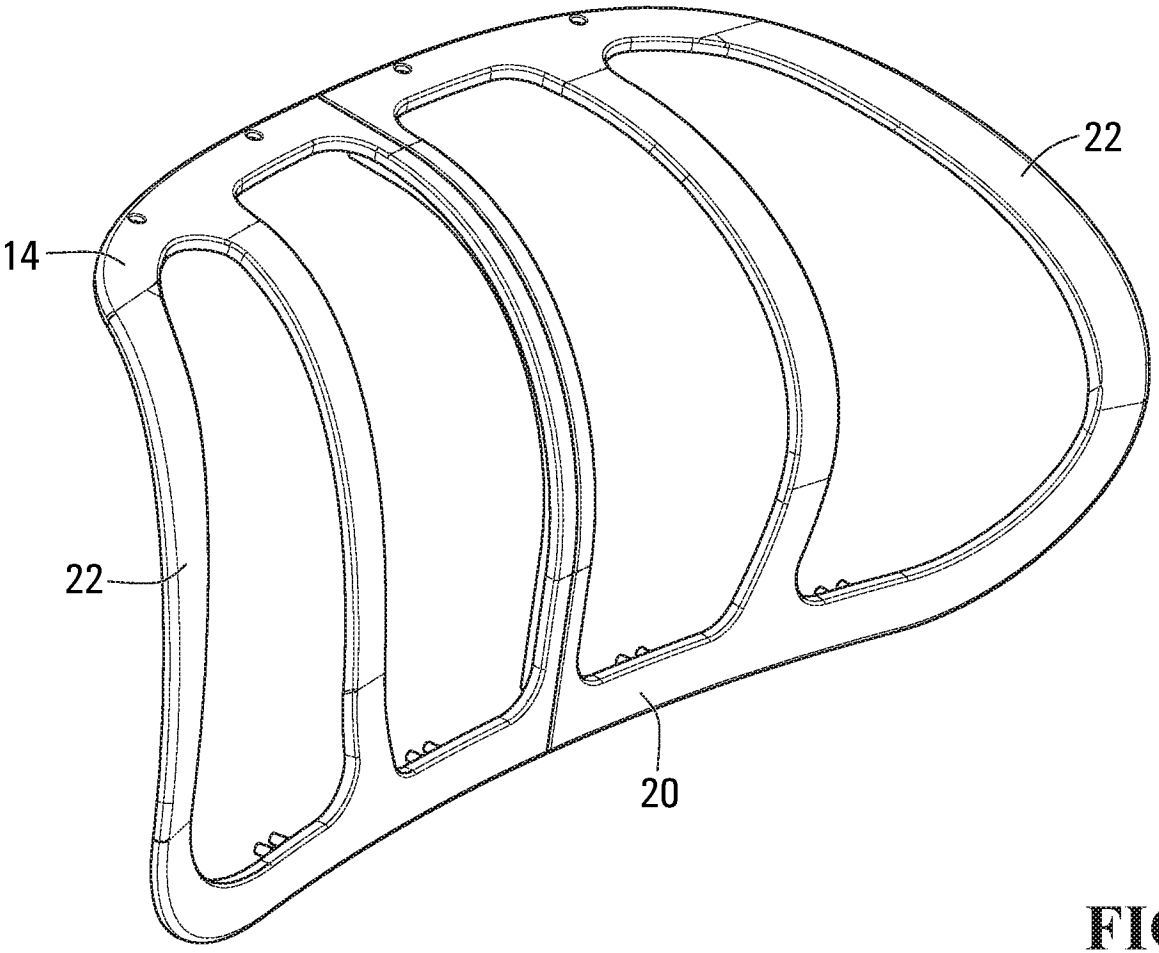
FIG. 6 in a front perspective view, illustrates the frame of the quadratic surface grate cover of FIG. 1.
Figure 7:
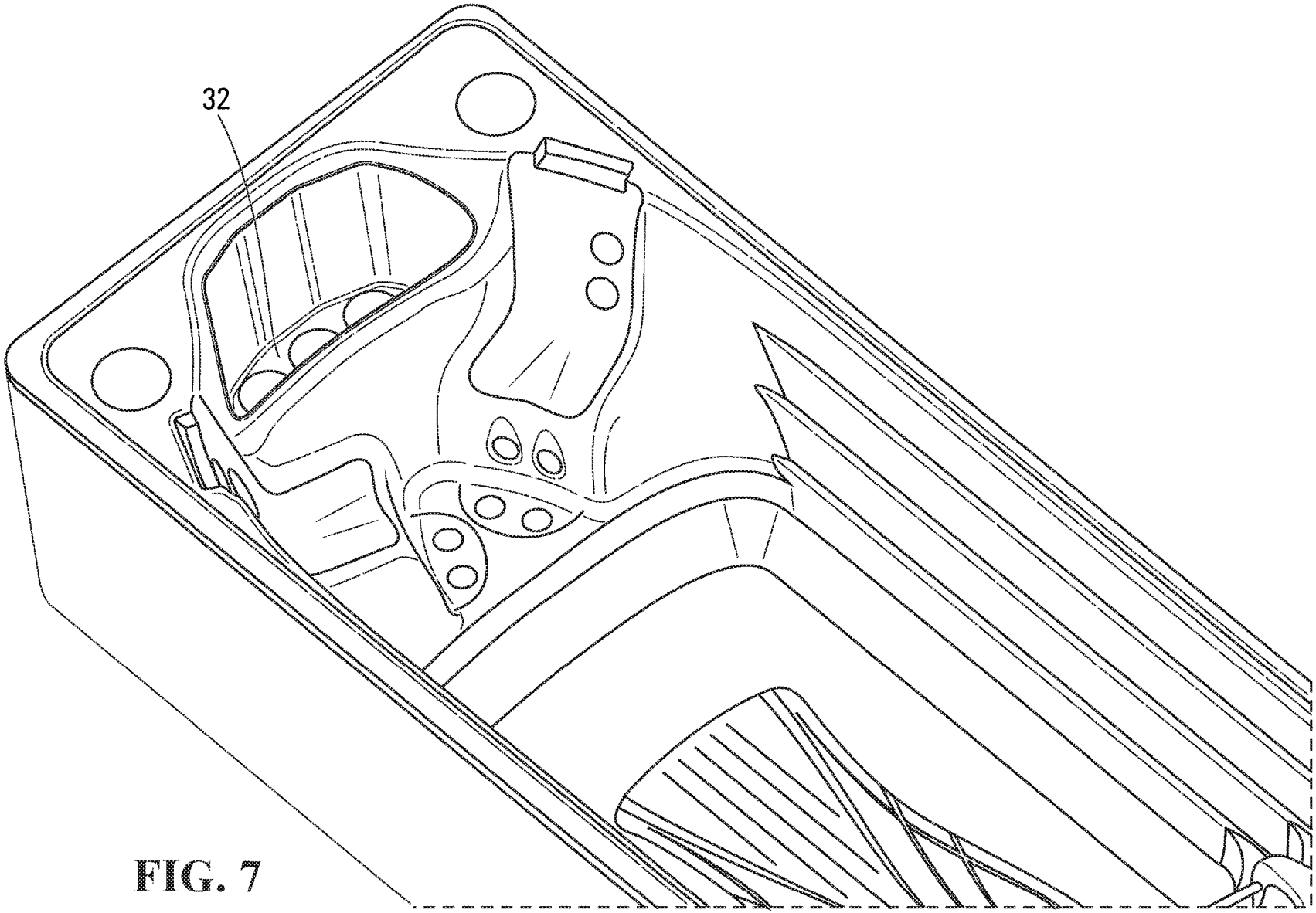
FIG. 7 in a top perspective view, illustrates the positioning of the quadratic surface grate cover relative to the sump within the swimming pool.
Figure 8:
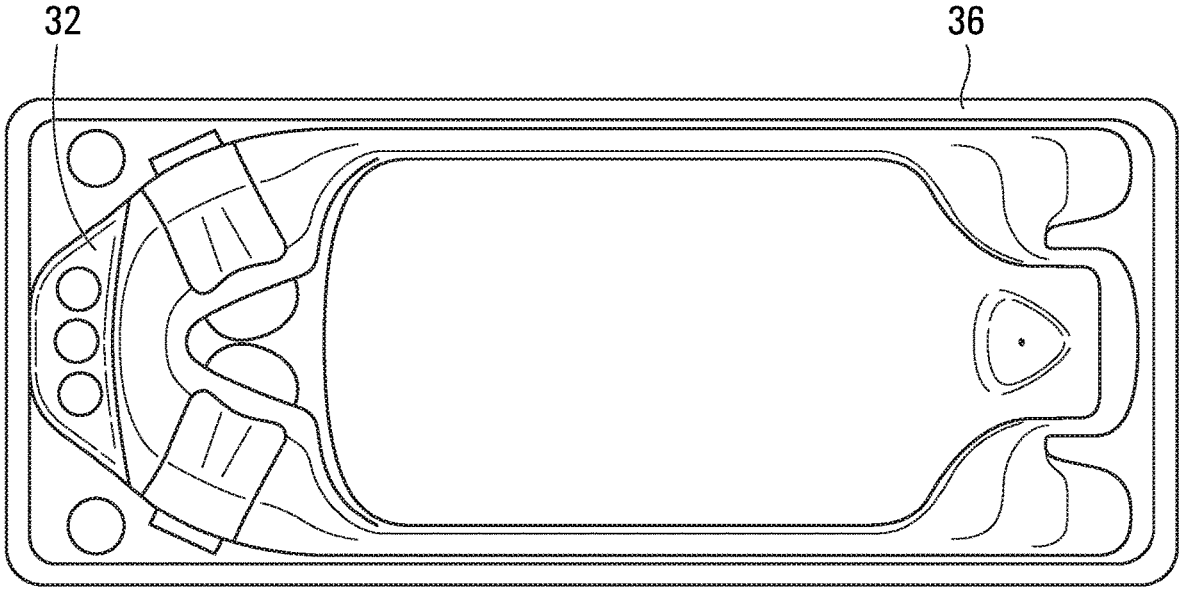
FIG. 8 in a top plan view, illustrates the swimming pool of FIG. 1.
Figure 9A:
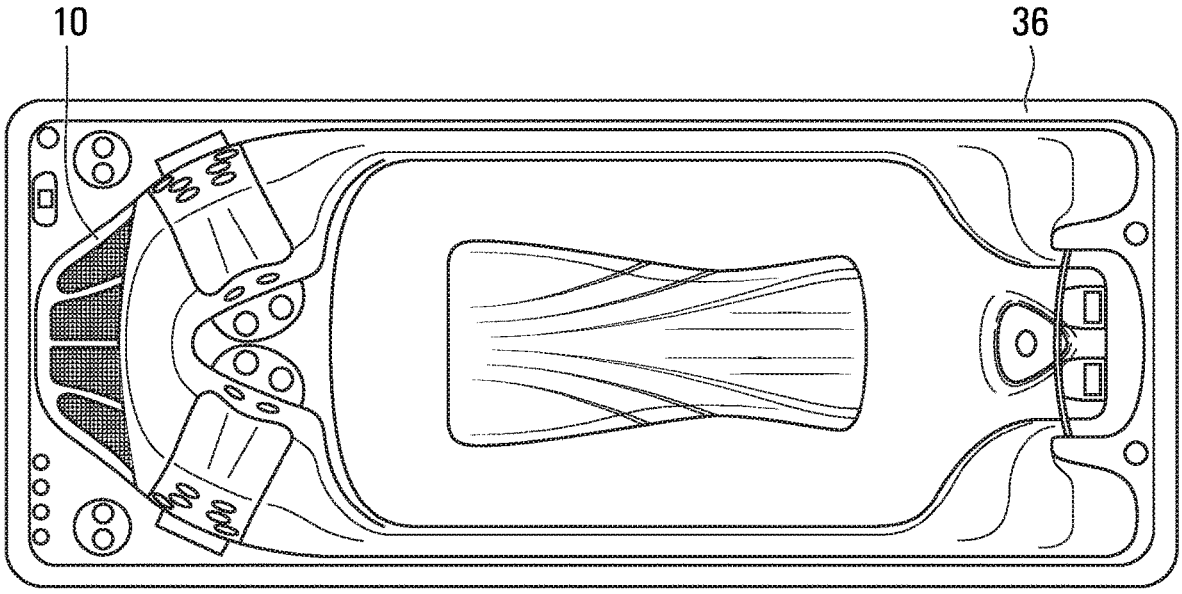
FIG. 9A in a top plan view, illustrates the quadratic surface grate cover positioned within the swimming pool.
Figure 9B:
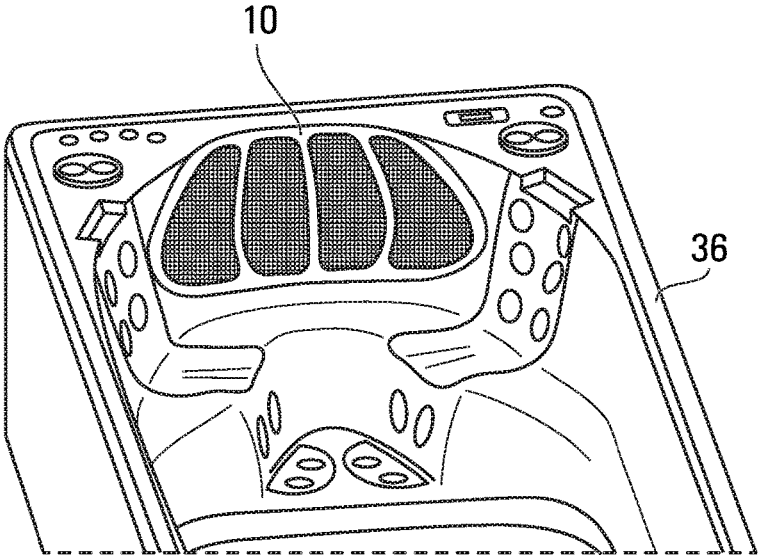
FIG. 9B in a cut-away top perspective view, illustrates the quadratic surface grate cover positioned within the swimming pool.
Figure 10A:
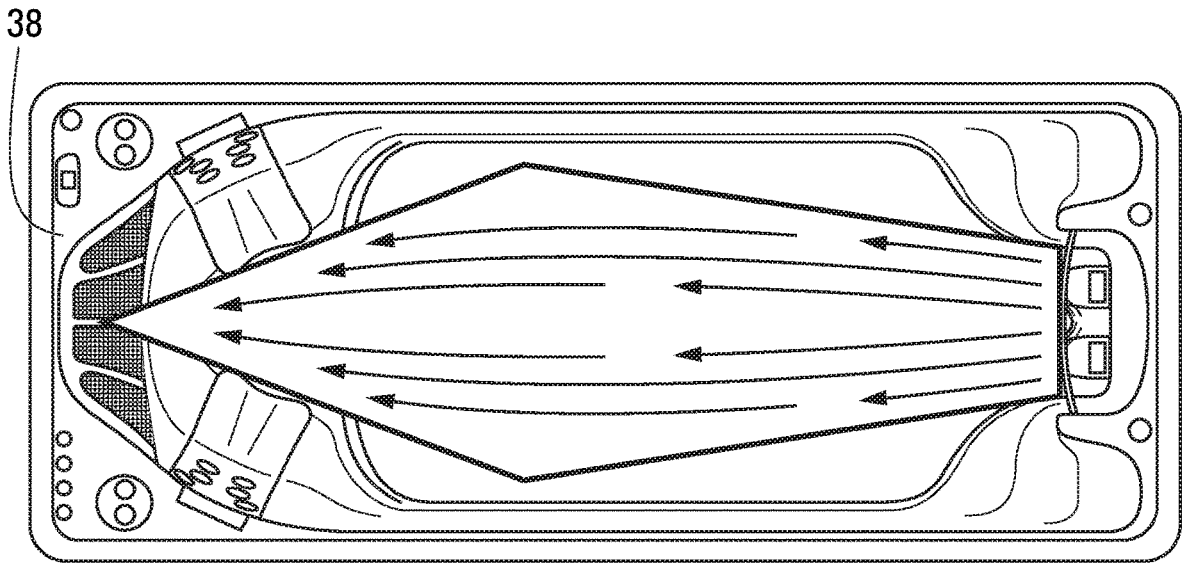
FIG. 10A in a top plan view, illustrates the flow of water through the swimming pool towards the quadratic surface grate.
Figure 10B:
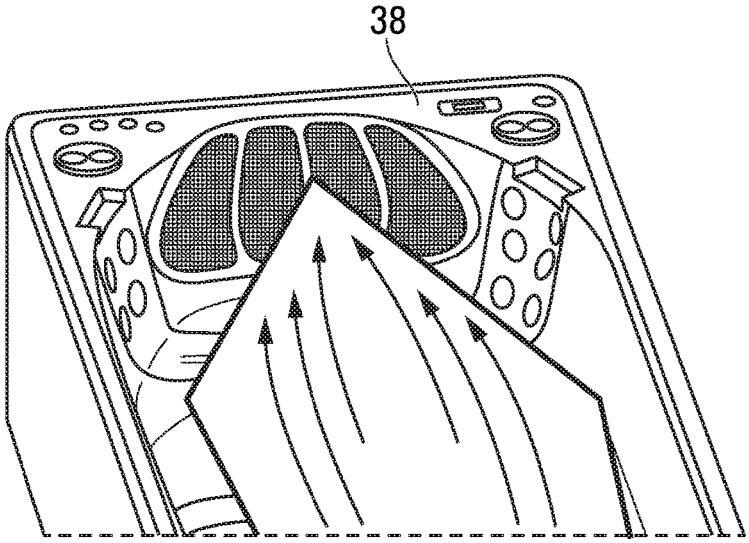
FIG. 10B in a cut-away top perspective view, illustrates the flow of water through the swimming pool towards the quadratic surface grate.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Referring to FIGS. 1 through 18, there is illustrated a quadratic surface grate cover 10 in accordance with a preferred embodiment of the present invention. The quadratic surface grate cover 10 for a swimming pool includes a hyperbolic paraboloid shaped frame 12 having front side 14, a back side 16, a top side 18 that runs parallel to a bottom side 20 and two non-parallel ends 22 that connect the top and bottom sides 18 and 20 respectively.

At least four trapezoid-shaped vented portions 24 positioned within and across the frame 12 wherein the frame 12 and the trapezoid-shaped portions 24 flex in a concave direction between the two non-parallel ends 22 and a convex direction between the parallel top and bottom sides 18 and 20 respectively.

More specifically each trapezoid-shaped vented portion 24 has a first concave surface 26 that curves from an outside edge 30 of the frame towards a centre of the frame, and a second convex surface 28 that curves away from the centre of the frame 12. This combination ensures that there is never a portion of the user's body being suctioned against the quadratic surface grate cover 10. Specifically the orientation of the curvatures allow for the lateral flow and upper flow of the water into a sump 32 but under the user positioned close to the quadratic surface grate cover 10.

The four trapezoid-shaped vented portions 24 may each have an open corrugated structure with "I" cross section of the bar grating, this structure keeps a material thin and lightweight, stiff enough to resist bending under considerable loads. The quadratic surface grate cover cross section could also use more sophisticated shapes: C, H, T, U, S, Z or combination of those, used often for all types of "thin-walled profiles". The quadratic surface grate cover may be made of plastic materials, plastic composite material, carbon fiber glass fiber reinforced polymers, metals, metal alloy or other suitable material. Glass Fiber Reinforced Polymers (GFRP) is a category of plastic composite that specifically uses glass fiber materials to mechanically improve the strength and stiffness of plastics. Moreover, GFRP presents very flexible design solutions, due to its extraordinary fabrication adaptability, high durability and structural efficiency (strength-to-weight ratio).

The orientation of the quadratic surface grate cover 10 therefore creates a low pressure on the back side 38 of the swimming pool or swim spa 36, which allows for the correct water flow produced by the swim jets. More specifically the quadratic surface grate cover 10 ensures that the flow of water goes directly through the quadratic surface grate cover without creating turbulence at a very low speed.

Figure 11:
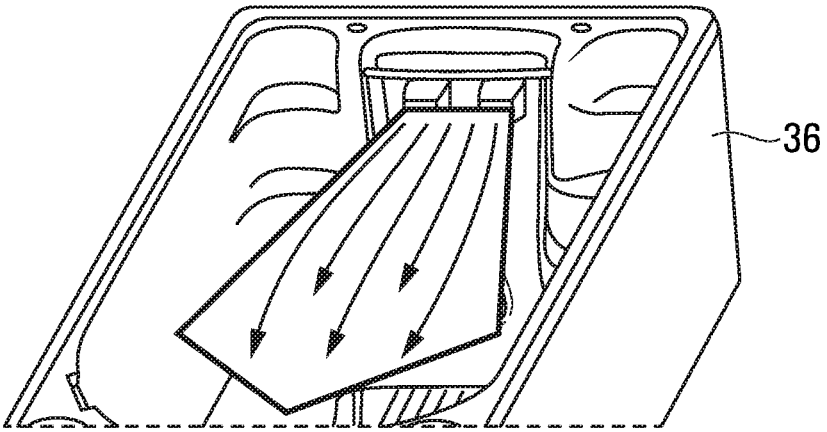
FIG. 11 in a cut-away top perspective view, illustrates the flow of water through the swimming pool towards the quadratic surface grate.
Figure 12A:
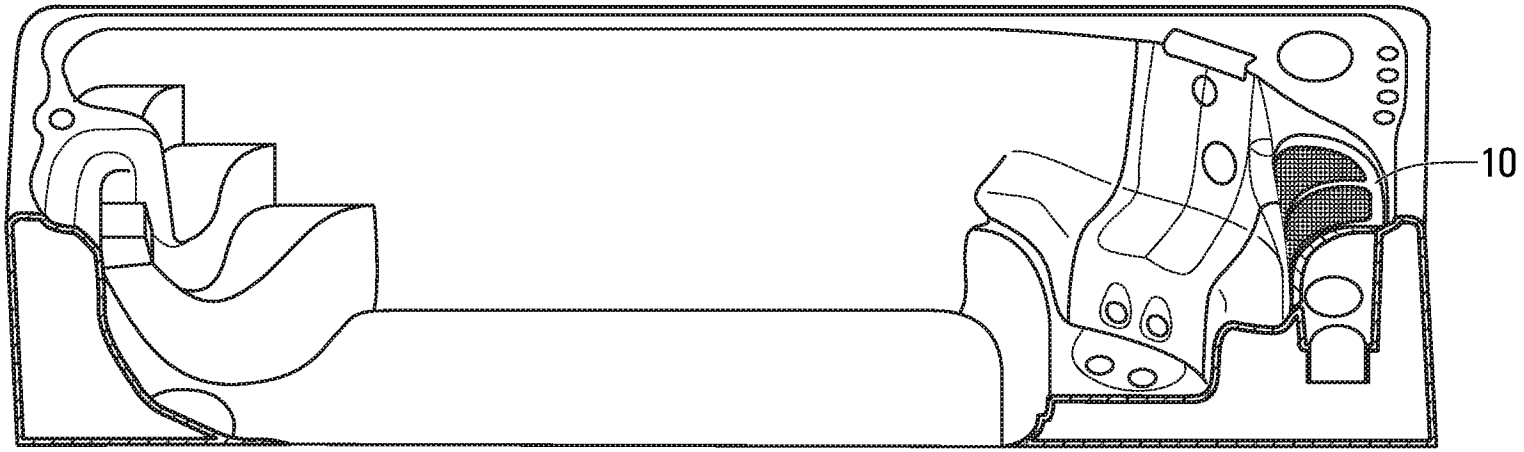
FIG. 12A in a side cross-section view, illustrates the swimming pool with the quadratic surface grate.
Figure 12B:
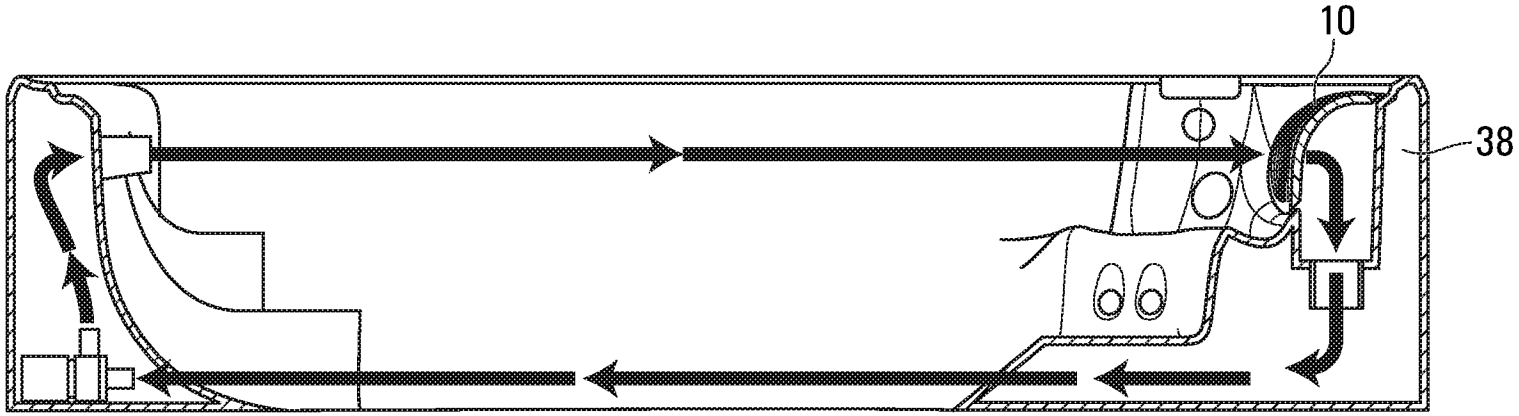
FIG. 12B in a side cross-section view, illustrates the water flow through the swimming pool towards the quadratic surface grate.
Figure 13:
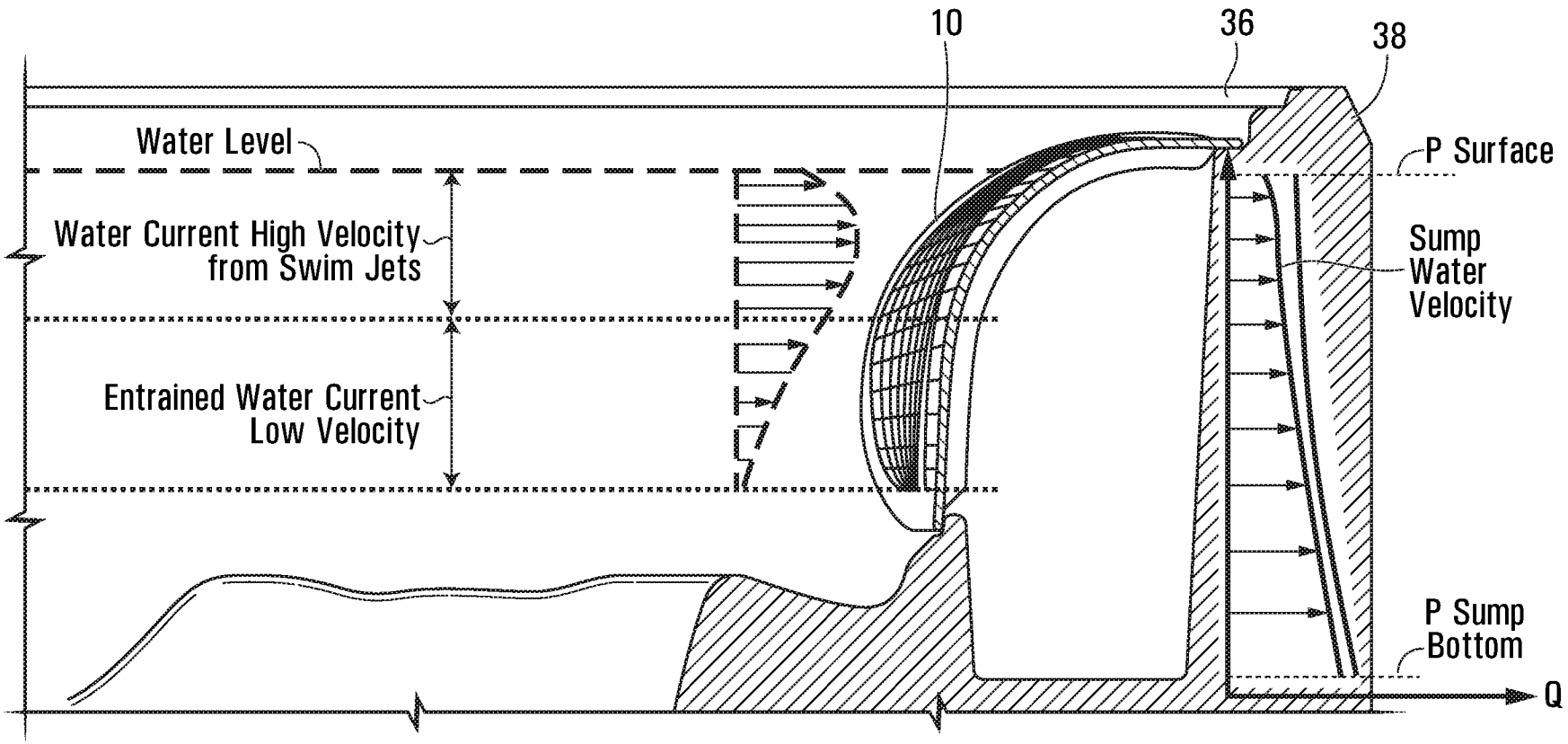
FIG. 13 in a side cross-section view, illustrates the variation of the pressure, flow, speed of water through the quadratic surface grate into the sump.
Figure 14:
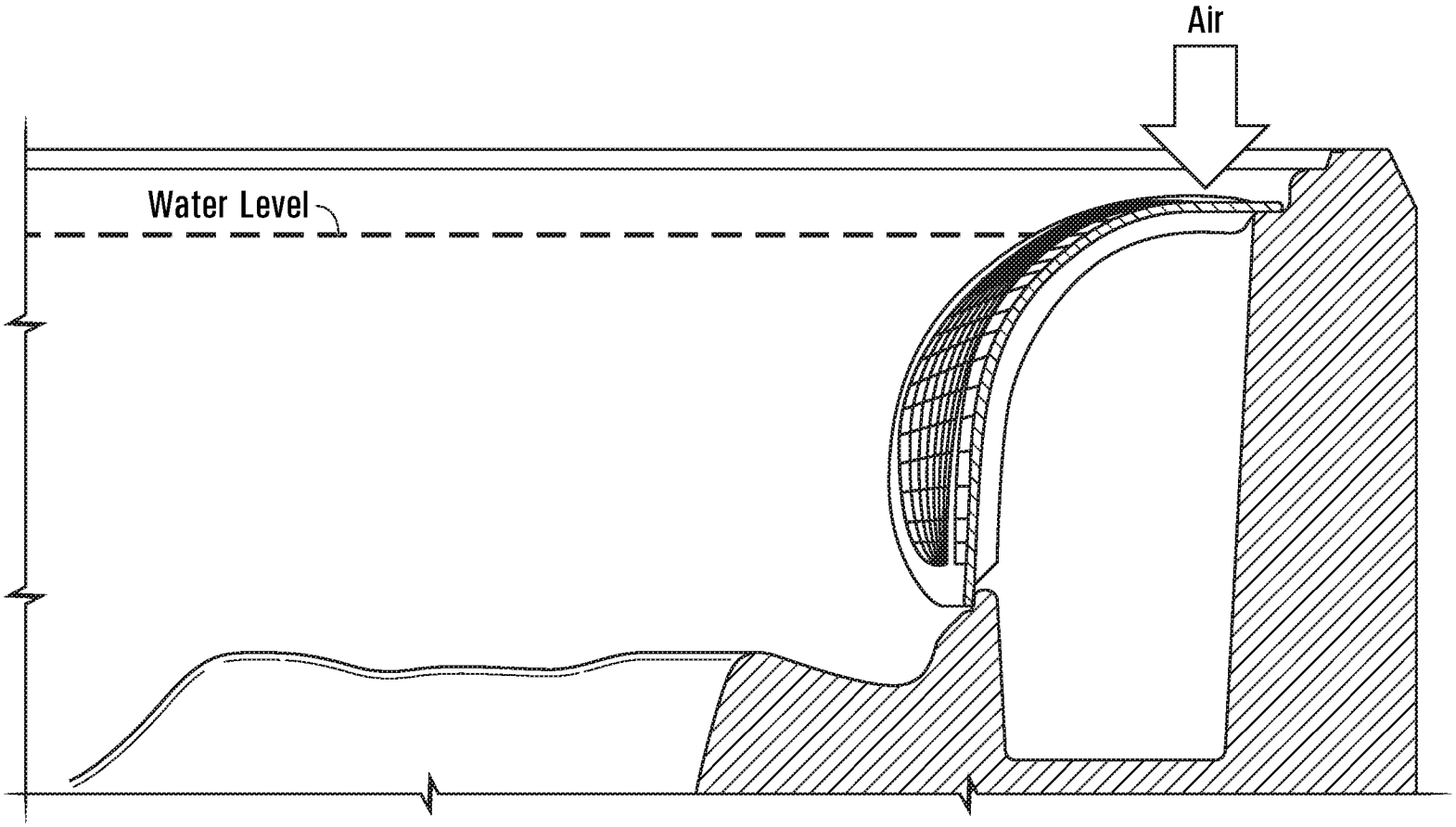
FIG. 14 in a side cross-section view, illustrates the quadratic surface grate of FIG. 1 relative to the water height and access to air.
Figure 15:
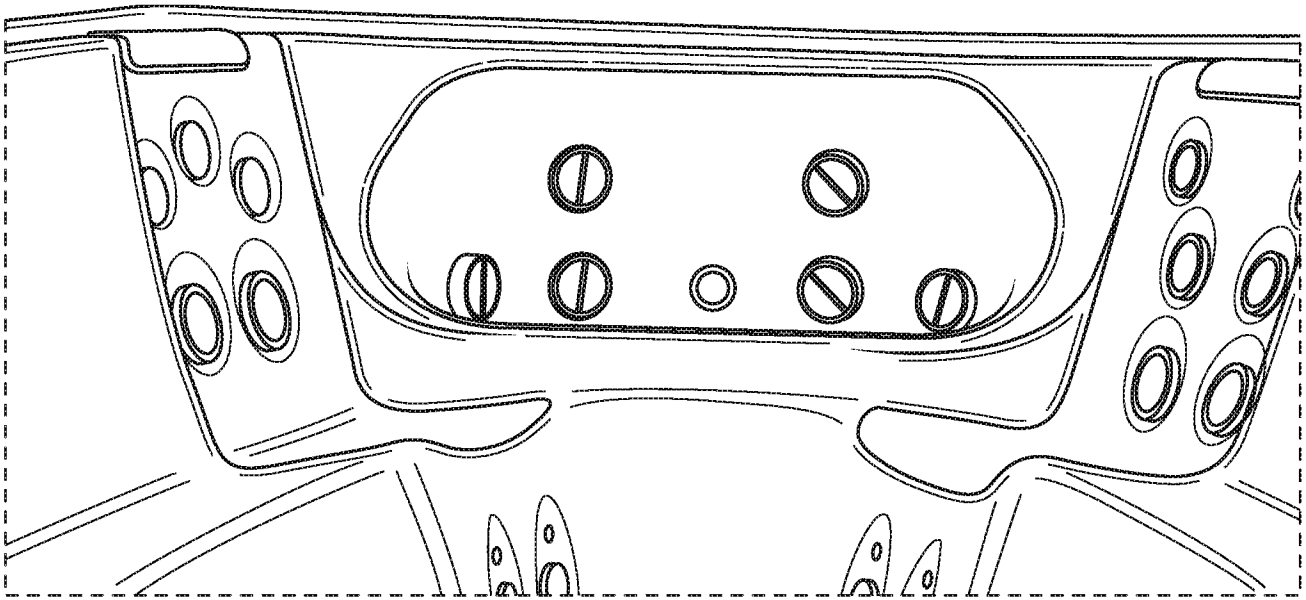
FIG. 15 in a front perspective view, illustrates the positioning of the suction fittings relative to the sump for the movement of water through the quadratic surface grate of FIG. 1.
Figure 16:
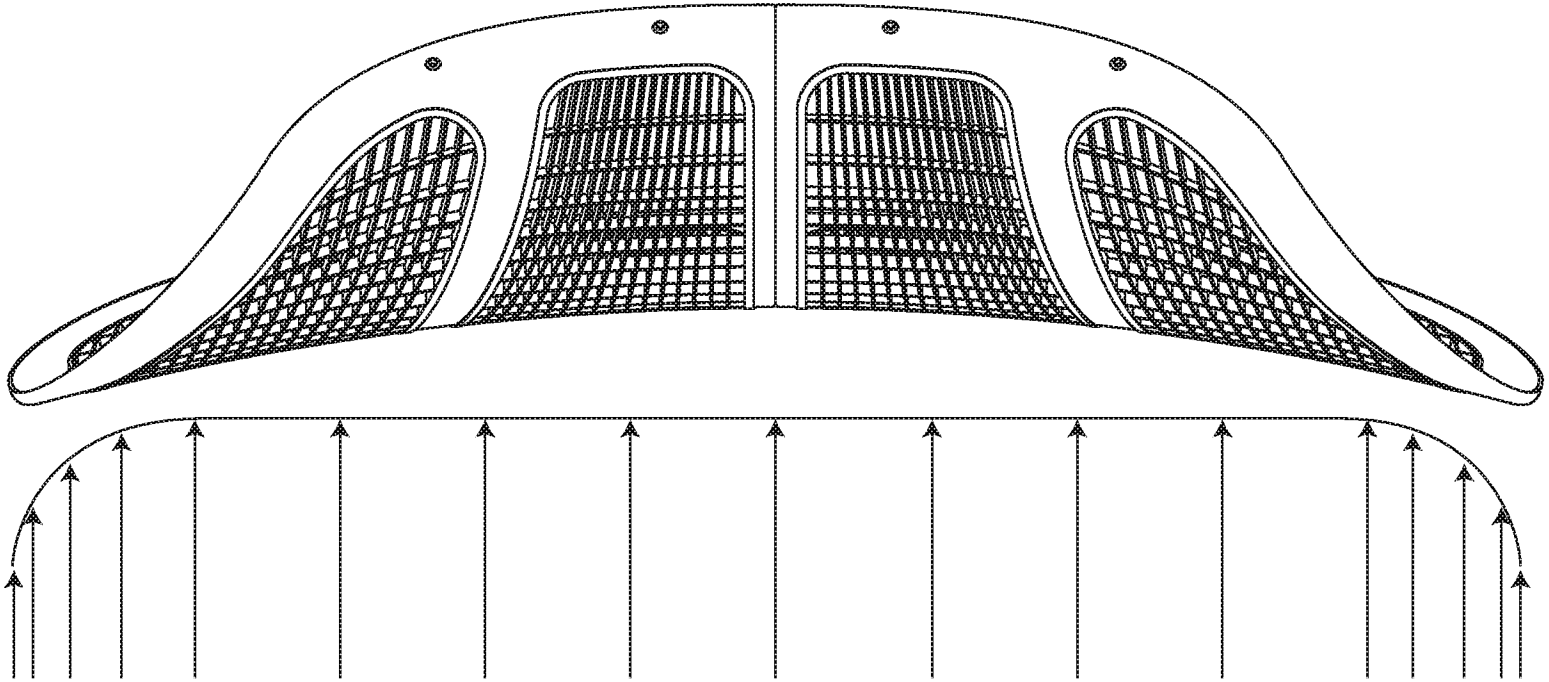
FIG. 16 in a side schematic view, illustrates the water current velocity distribution towards the quadratic surface grate of FIG. 1.
Figure 17:
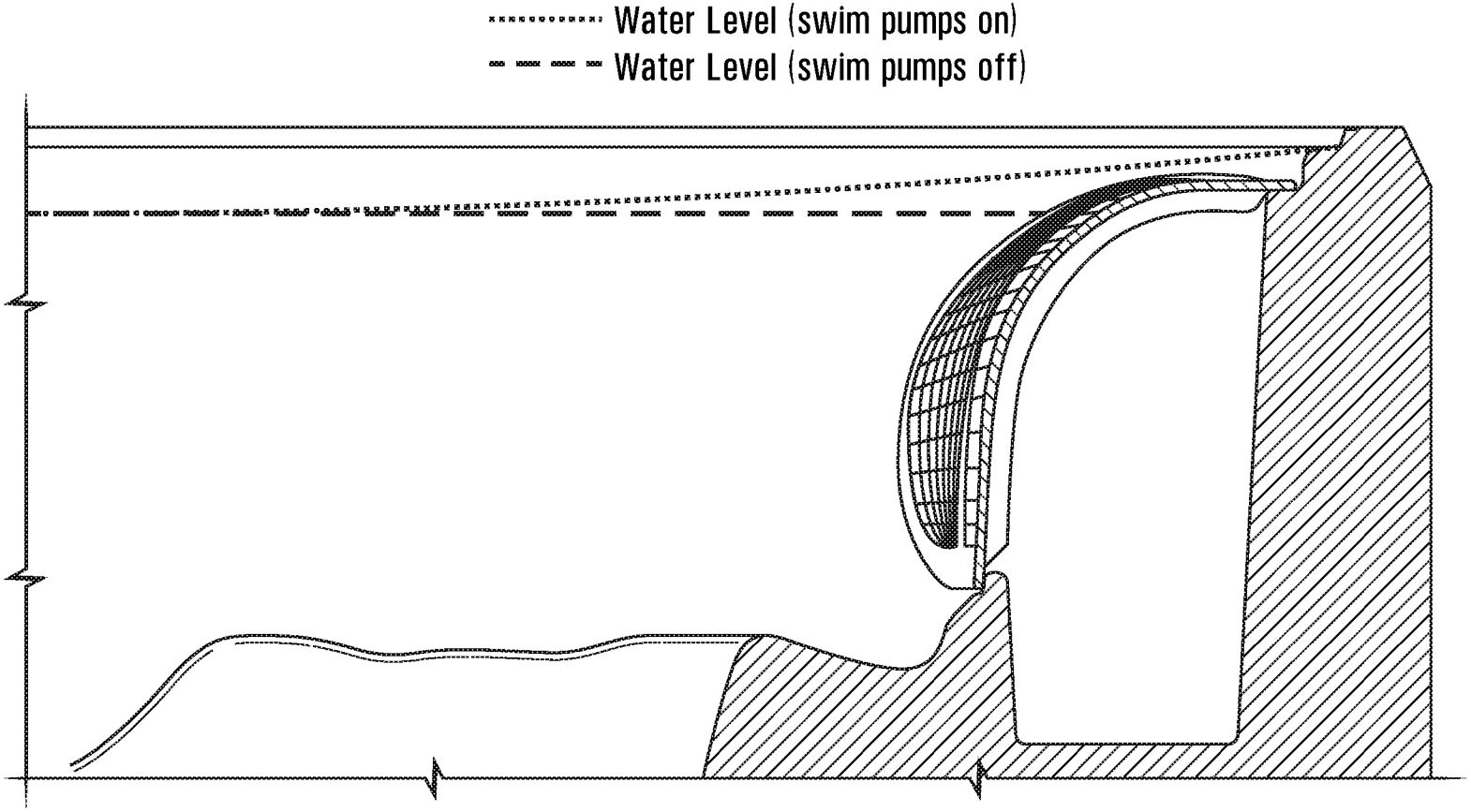
FIG. 17 in a side schematic view, illustrates the change in height of the water against the quadratic surface grate when the swimming pool pump is activated.
Figure 18:
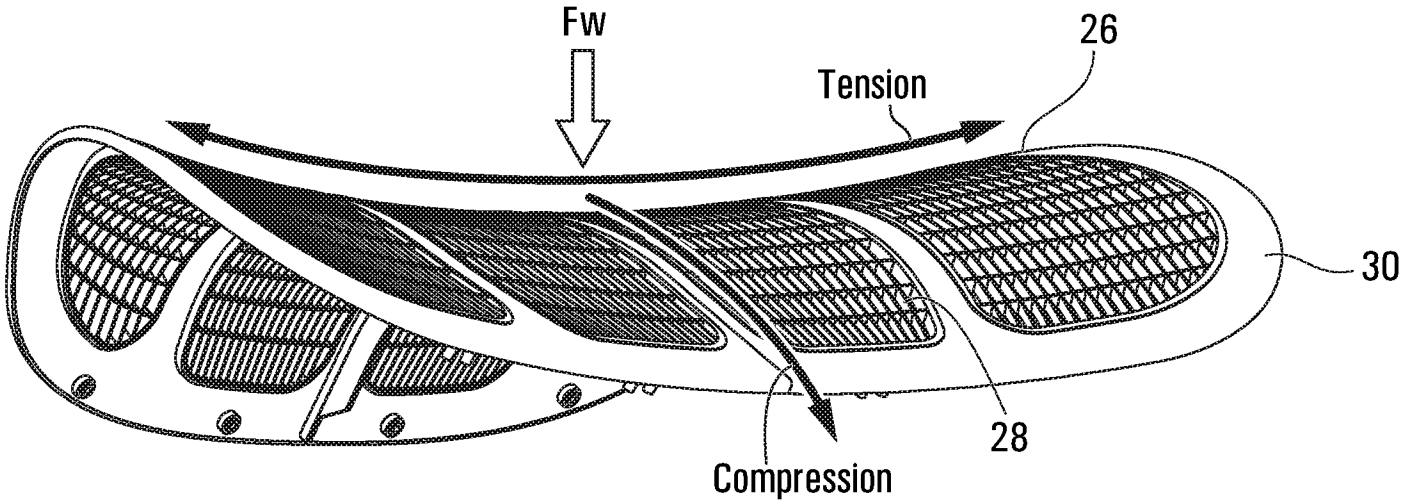
FIG. 18 in a side schematic view, illustrates the impact of the water flow on the quadratic surface grate when the swimming pool pump is activated.

Referring to FIGS. 11 to 12*b*, typically the swim spa water flow works similarly with a conveyor belt or bicycle chain. The quadratic surface grate cover 10 enables the water flow to form in a closed loop circuit, starting with the swim pumps, swim jets along swim spa, quadratic surface grate cover, pumps suction fittings, pumps suction piping back to swim pumps.

The quadratic surface grate cover 10 also acts as shock absorber or water shock arrestor when the water flow moves through the closed loop. Due to its residual speed, the water flow will rise above the top of the quadratic surface grate cover 10. The quadratic surface grate cover attenuates the movement of the water flow by acting as a shock absorber, thus drastically reducing its kinetic energy (by friction with the four trapezoid-shaped vented portions) and thus preventing it from changing its direction to 180 degrees.

More specifically the high velocity water flow moving close to the surface of the water in the swim spa engages with the trapezoid-shaped vented portions 24 thereby directing the water flow into the sump 32 and reducing the water flow to a lower speed at the top of the swim spa. The water velocity increases towards the bottom of the sump because of the lower pressure created by the suction fittings.

Referring to FIGS. 1 through 18, there is illustrated a quadratic surface grate cover for a sump having suction fittings in accordance with a second preferred embodiment of the present invention. The quadratic surface grate cover 10 for a sump having suction fittings for a swimming pool includes a hyperbolic paraboloid shaped frame having front side, a back side, a top side that runs parallel to a bottom side and two non-parallel ends that connect the top and bottom sides.

At least four trapezoid-shaped vented portions positioned within and across the frame wherein the frame and the trapezoid-shaped portions flex in a concave direction between the two non-parallel ends and a convex direction between the parallel top and bottom sides. Furthermore the vented portions shape and size allow water to circulate at a very low speed due to a very big cross section area avoiding the turbulence and vortices.

The quadratic surface grate cover may be installed with a high volume sump into a corresponding shaped recess. The recess may contain all the various pump fitting suctions for swim spa, swimming pool, spas, and whirlpools. The quadratic surface grate cover allows for optimized flow of water directly through it without creating turbulence at a very low speed. Thus the quadratic surface grate cover helps maintain the main high capacity suction for all swim spa pumps when in operation The quadratic surface grate cover has an overall hyperbolic paraboloid shape. The frame may be better defined as having a curved perimeter with rounded edges for a smooth surface. The perimeter may include a small sidewall to allow for easy installation. The quadratic surface grate cover may be an injection molded for easy assembly. The frame may be constructed in two parts and assembled with the four trapezoid-shaped vented portions using fasteners such as screws and adhesive. The quadratic surface grate cover is sufficiently large enough to cover all of the pumps fitting suction intakes.

The above identified application has solved the problem of entrapment by making the cover in a quadric-shaped configuration. As such there are no flat surfaces presented to any part of the user's body. Moreover the quadratic surface grate cover has a greater surface area than that of the exposed user's body size, thereby eliminating any chance of the user's body being sucked onto the surface of the quadratic surface grate cover.

The quadratic surface grate cover for a sump having suction fittings has a secondary layer of anti-entrapment protection positioned at the top side of the quadratic surface grate cover. Specifically the trapezoid-shaped portions closest to the top side of the quadratic surface grate cover are exposed to air, thereby providing a constant source of air to pump. This orientation allows the pumps to suck air in even if the quadratic surface grate cover is ever blocked on purpose and therefore prevents the entrapment creating a starvation of the impeller.

The quadratic surface grate cover provides for a number of improved characteristics namely strength, increased anti-block action, and increased anti entrapment protection. The quadratic surface grate cover may be connected to the sump through an assembly system made up of plates and fasteners or it may be connected through the frame itself providing for greater water anti-vortex and return. The quadratic surface grate cover provides a passageway between the front swim jets and the back of the swim spa capturing the entire amount of water due to the low pressure created by the pumps suctions in the sump.

Other variations and modifications of the invention are possible. All such modifications or variations are believed to be within the sphere and scope of the invention as defined by the claims appended hereto.

We claim:

1. A quadratic surface grate cover for a swimming pool comprising:

(a) a hyperbolic paraboloid shaped frame having front side, a back side, a top side that runs parallel to a bottom side and two non-parallel ends that connect the top and bottom sides;

(b) at least four trapezoid-shaped vented portions positioned within and across the frame;

wherein the frame and the trapezoid-shaped portions flex in a concave direction between the two non-parallel ends and a convex direction between the parallel top and bottom sides.

2. A quadratic surface grate cover for a swimming pool as claimed in claim 1 wherein the frame is saddle shaped having an interior angle of at least 90°.

3. A quadratic surface grate cover for a swimming pool as claimed in claim 1 wherein the vents in each trapezoid-shaped portion are at least a thousand per square inch.

4. A quadratic surface grate cover for a swimming pool as claimed in claim 1 wherein trapezoid-shaped portion at the top side of the frame creates an air vent.

5. A quadratic surface grate cover for a swimming pool as claimed in claim 1 wherein the frame has a minimum size of 18" by 23".

6. A quadratic surface grate cover in combination with a sump having suction fittings for a swimming pool comprising:

(a) a hyperbolic paraboloid shaped frame having front side, a back side, a top side that runs parallel to a bottom side and two non-parallel ends that connect the top and bottom sides;

(b) at least four trapezoid-shaped vented portions positioned within and across the frame;

wherein the frame and the trapezoid-shaped portions flex in a concave direction between the two non-parallel ends and a convex direction between the parallel top and bottom sides.

7. A quadratic surface grate cover for a swimming pool as claimed in claim 1 wherein the water flows through the quadratic surface grate cover at a velocity less than 0.3 feet per second.

8. A quadratic surface grate cover for a swimming pool as claimed in claim 1 wherein water current capacity over the quadratic surface grate cover is over 3000 GPM at 1 foot per second and over 4000 GPM at 1.5 feet per second.

* * * * *